US010763063B2

(12) United States Patent
Bull et al.

(10) Patent No.: US 10,763,063 B2
(45) Date of Patent: Sep. 1, 2020

(54) PRESSURE SWITCH

(71) Applicant: Halliburton Energy Services, Inc., Houston, TX (US)

(72) Inventors: Brad Robert Bull, Duncan, OK (US); George James Melton, II, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 19 days.

(21) Appl. No.: 16/251,357

(22) Filed: Jan. 18, 2019

(65) Prior Publication Data

US 2020/0234896 A1 Jul. 23, 2020

(51) Int. Cl.
*H01H 35/34* (2006.01)

(52) U.S. Cl.
CPC ..... *H01H 35/34* (2013.01)

(58) Field of Classification Search
CPC ..... H01H 35/34
USPC ..... 200/83 R
See application file for complete search history.

(56) References Cited

U.S. PATENT DOCUMENTS

| | | | | |
|---|---|---|---|---|
| 5,149,927 | A | 9/1992 | Stahly | |
| 5,554,834 | A | 9/1996 | Ellett | |
| 5,670,766 | A | 9/1997 | Ellett | |
| 6,255,609 | B1 * | 7/2001 | Samuelson | G01L 9/0089 200/82 E |
| 8,431,848 | B2 | 4/2013 | Bruchal | |
| 10,503,181 | B2 * | 12/2019 | Young | G05D 16/2013 |

* cited by examiner

*Primary Examiner* — Edwin A. Leon
*Assistant Examiner* — Lheiren Mae A Caroc
(74) *Attorney, Agent, or Firm* — John W. Wustenberg; Baker Botts L.L.P

(57) ABSTRACT

A pressure switch system provides a safety mechanism for equipment at a well site environment to prevent the opening or release of certain components when an unsafe condition exists. A pressure switch assembly of the system includes a diaphragm that transitions to an extended position as pressure of a pressurized fluid is flowed through a fluid pathway of the assembly. The diaphragm couples to a pin that transitions along with a dart based on the pressure at the diaphragm. When pressure reaches or exceeds a threshold, the dart is transitioned to a location proximate to a sensor. The sensor triggers actuation of a switch to prevent release or opening of a remote connector of a hydraulics unit until the pressure is at or falls below the threshold. The threshold is set to a pressure based on the unsafe condition.

20 Claims, 6 Drawing Sheets

PRESSURE SWITCH

TECHNICAL FIELD OF THE INVENTION

The present disclosure relates generally to a pressure switch and more particularly to a durable switch that can activate at low pressures while in a high pressure environment.

BACKGROUND

Hydrocarbons, such as oil and gas, are produced from subterranean reservoir formations that may be located onshore or offshore. The processes involved in recovering hydrocarbons from a reservoir are becoming increasingly complex. Subterranean production is a highly expensive and extensive endeavor and the industry generally relies heavily upon educated predictions of reservoir conditions to characterize the reservoir prior to making substantial investments to optimize well placement within the reservoir, optimize production of hydrocarbons, and performing the necessary steps to produce, process and transport the hydrocarbons from the reservoir.

An operation at a well environment may require that a wellhead connection unit (WCU) be brought on site. Typically, one arm of the WCU will connect to a source, for example, a manifold or manifold trailer, that provides or supplies a pressurized fluid and then another arm of the WCU will connect to the wellhead. For example, a crane may be utilized to connect the WCU to the wellhead using a crane. The crane picks or lifts an arm of the wellhead connection unit and moves the arm over to the wellhead. A remote connector is disposed on each arm of the wellhead connection unit. An arm is positioned such that the remote connector of the arm engages the wellhead. Fluid flows from the manifold trailer into a first arm of the WCU coupled to the manifold trailer. The fluid is flowed through the first arm to the second arm of the WCU. The second arm is coupled to the wellhead such that the fluid flows through the second arm to the wellhead.

The flow of fluid from the manifold through the arm of the WCU coupled to the wellhead is pressurized. This pressurization may be hazardous to personnel and the surrounding environment. For example, opening up or activating the hydraulics system at the wellhead that connects the remote connector to the wellhead before depressurization may release pressurized fluid. Such a release may cause harm or injury to the surrounding environment including personnel and equipment. A fail-safe system that prevents the remote connector from disengaging from the wellhead while the manifold is pressurized is needed.

Figure 1:
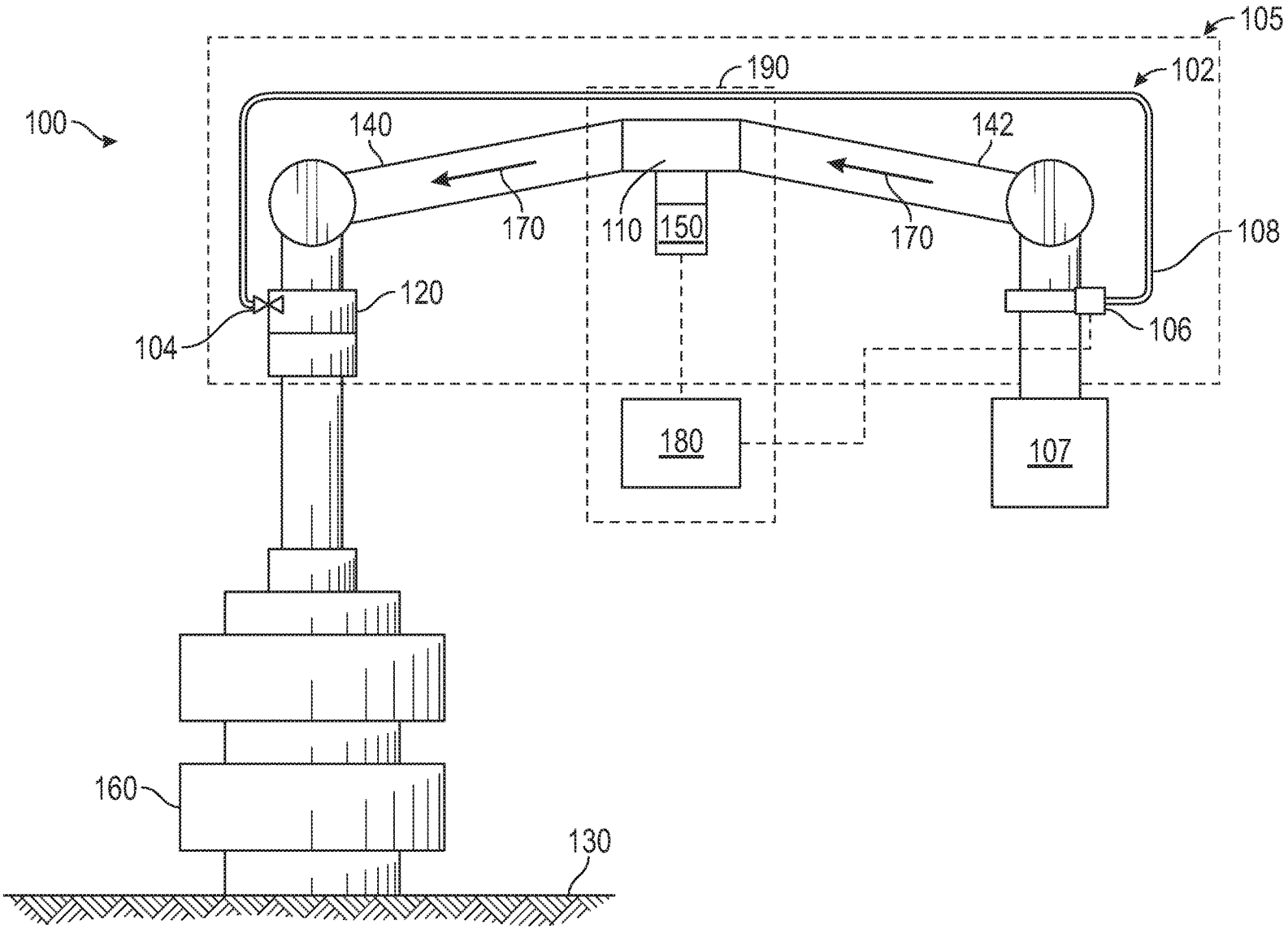
FIG. 1 is an illustrative well environment, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

At a well site environment, a wellhead is generally coupled to other equipment so that fluid may be flowed to the wellhead. Personnel may be required to assist with engaging and disengaging tubing or piping. For example, a wellhead connection unit (WCU), for example, for example, an ExpressKinect™ Wellhead Connection Unit (EKWCU) or an ExpressKinect™ Quicklatch (EKQL) (both available from Halliburton), at a well site environment may be utilized to provide faster connection of the wellhead to a fluid as compared to traditional rig-up equipment. The WCU, for example, a EKWCU, may comprise a plurality of arms. One arm may couple to a manifold while another arm may couple to the wellhead via a remote connector of the arm. Fluid may flow from the manifold through the arms. The fluid that is flowed to the wellhead may be pressurized. The pressurization of the fluid may vary according to different stages of an operation. Thus, before disengagement of the remote connector, for example, an EKQL, from the wellhead, the pressure must be eliminated or reduced to prevent harm or injury to personnel or equipment at or about the wellhead.

To increase safety during operation and to comply with industry or customer-specific requirements, the present disclosure provides a fail-safe switch system or pressure switch assembly that prevents the remote connector from disengaging from the wellhead while pressurized. The fail-safe system must operate or function at both high and low pressures. However, typical pressure transducers have operating ranges that do not span both high and low pressures. According to one or more aspects of the present disclosure, a fail-safe switch system operates or functions accurately at both high and low pressure ranges to provide a safety mechanism that activates at low pressures while maintaining functionality at very high pressures to prevent disengagement of the remote connector for a wide range of pressurization. For example, the fail-safe switch system of the present disclosure may operate accurately from a low pressure threshold of at or about thirty pounds per square inch (PSI) (approximately 206.843 kilopascals (kPa)) to a high pressure threshold of at or about 15,000 PSI (approximately 103421.35 kPa) to 22,500 PSI (approximately 155132.04 kPa).

In one or more embodiments of the present disclosure, an environment may utilize an information handling system to control, manage or otherwise operate one or more operations, devices, components, networks, any other type of system or any combination thereof. For purposes of this disclosure, an information handling system may include any instrumentality or aggregate of instrumentalities that are configured to or are operable to compute, classify, process, transmit, receive, retrieve, originate, switch, store, display, manifest, detect, record, reproduce, handle, or utilize any form of information, intelligence, or data for any purpose, for example, for a maritime vessel or operation. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data, instructions or both for a period of time. Computer-readable media may include, for example, without limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming, but would nevertheless be a routine undertaking for those of ordinary skill in the art having the benefit of the present disclosure.

The terms "couple" or "couples," as used herein are intended to mean either an indirect or direct connection. Thus, if a first device couples to a second device, that connection may be through a direct connection, or through an indirect electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

FIG. 1 illustrates a well site environment 100, according to one or more aspects of the present invention. Well site environment 100 comprises a wellhead 160 at a surface 130. In one or more embodiments, wellhead 160 may be located at a subsurface or subsea location. A wellhead connection unit 105 may comprise a hydraulics system 102, a first arm 140 (for example, a pipe, tube or line) coupled to a remote connector 120, a second arm 142 (for example, a pipe, tube or line) coupled to a source 107, and a pressure switch assembly 150. The remote connector 120 couples the first arm 140 to the wellhead 160. In one or more embodiments, remote connector 120 may couple any one or more arms 140 to any type of wellhead, to a rig, or to another arm or piping at a surface 130 where the wellhead or arm or piping are at any location. The second arm couples to a source 107, for example, a pressurized fluid source such as a manifold or manifold trailer. Pressure switch assembly 150 is fluidly coupled to the wellhead 160. For example, pressure switch assembly 150 may be coupled between the first arm 140 and the second arm 142. In one or more embodiments, an in-line connector 110, for example a T-connector, couples the pressure switch assembly 150 to the first arm 140 and the second arm 142.

Pressure switch system 190 comprises a pressure switch assembly 150 and a controller 180. The controller 180 may be communicatively coupled to the pressure switch assembly 150. In one or more embodiments, controller 180 is coupled directly or indirectly, wired or wirelessly or any combination thereof to pressure switch assembly 150. In one or more embodiments, controller 180 may be included within pressure switch assembly 150. In one or more embodiments, controller 180 may be located at a surface 130 of the well site environment 100 or may be located remotely from the well site environment 100.

In one or more embodiments, the second arm 142 may flow fluid 170 from the source 107 through first arm 140 and remote connector 120 to the wellhead 160. Fluid 170 may be pressurized at a high pressure by the source 107. In one or more embodiments, fluid 170 may be flowed at one or more high pressures and one or more flow rates to the wellhead 160 as required by one or more operations, for example, a stimulation operation. The remote connector 120 must withstand high pressures such as those used in stimulation operations and must provide rapid and convenient connection of the arm 140 to the wellhead 160 without damage to any personnel or other components or equipment at the well site environment 100. While the present disclosure references a stimulation operation, any high pressure operation may utilize any one or more embodiments of the present disclosure. A hydraulics system 102 comprises a hydraulic line 108, a hydraulic valve 104 and an actuator 106. The hydraulic line 108 couples the hydraulic valve 104 to the actuator 106. The actuator 106 is communicatively coupled directly or indirectly, wired or wirelessly or any combination thereof to the controller 180. The hydraulic valve 104 when actuated by the actuator 106 allows the remote connector 120 to be disengaged from the wellhead 160. For example, the controller 180 may actuate the actuator 106 when one or more measurements from the pressure switch assembly 150 are indicative of a safe pressure or a pressure that is at or below a pressure threshold. The pressure switch system 190 provides a fail-safe safety mechanism such that the hydraulic valve 104 is not permitted to be actuated when pressurized fluid 170 or pressure at the remote connector 120 is at or exceeds a threshold pressure.

In one or more embodiments, the controller 180 may be disposed or positioned within the WCU 105, proximal to the WCU 105 or remote from the WCU 105. In one or more embodiments, the controller 180 may comprise an information handling system, for example, information handling system 600 of FIG. 6.

Figure 2:
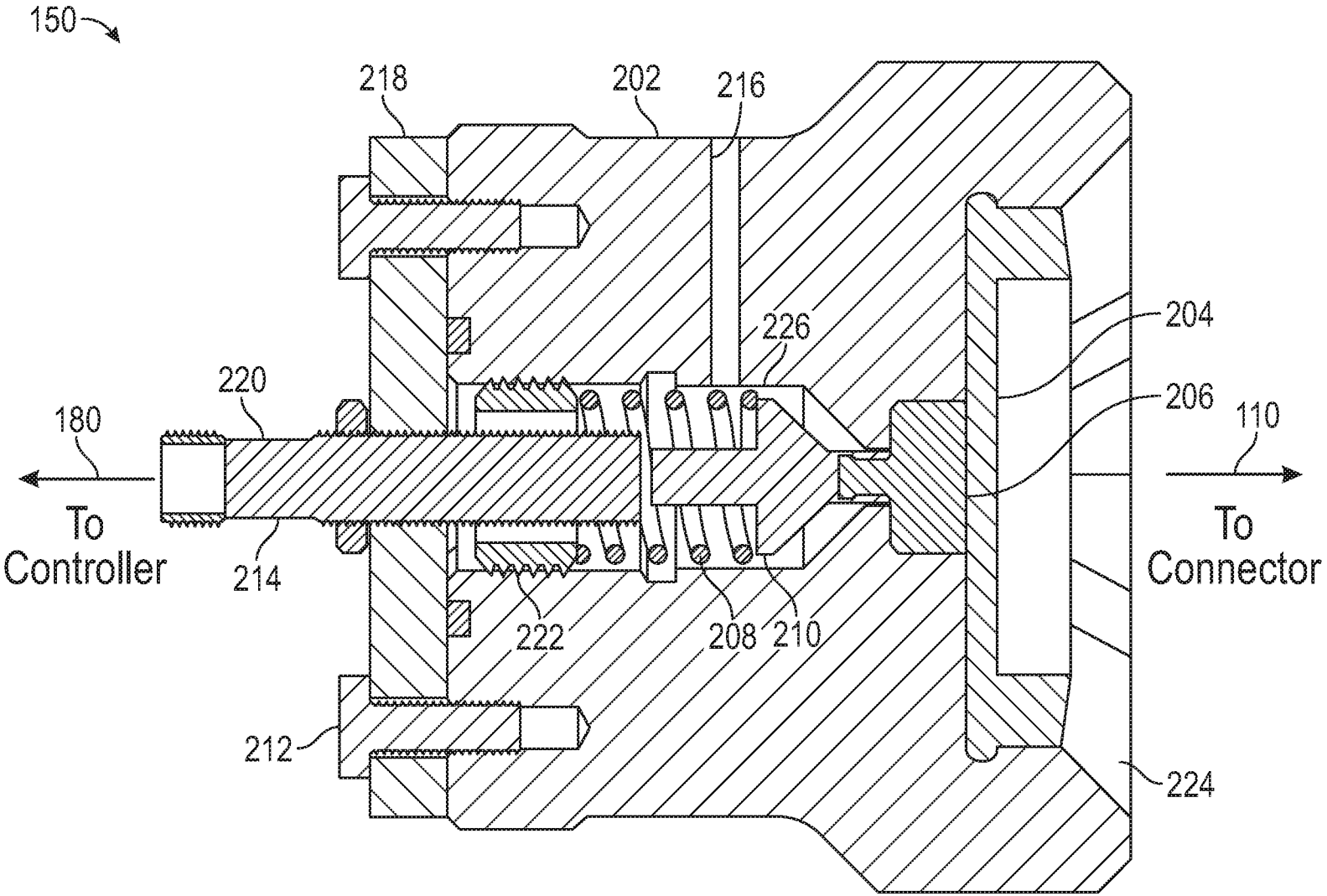
FIG. 2 is an illustrative pressure switch assembly in closed position, according to one or more aspects of the present disclosure.

FIG. 2 is an illustrative pressure switch assembly 150 in a closed position, according to one or more aspects of the present disclosure. The pressure switch assembly 150 comprises a body 202, a diaphragm 204, a pin 206, a compression assembly 208, a dart 210, communication pathway 214, pressure release 216, adjusting nut 222 and connector 224. A fastener 212 couples a cap 218 to a first end of the body 202 to position or secure a sensor 220 to the body 202. A second end of the body 202 comprises a connector 224. Connector 224 couples the body 202 to the connector 110 of the well site environment 100 of FIG. 1. A diaphragm 204 is disposed or positioned within the connector 224. The diaphragm 204 may be flush, abut, or otherwise proximal to the pin 206. The diaphragm 204 presses, pushes or exerts a pressure or force against the pin 206 based on a pressure of a fluid 170 that is at or exceeds a diaphragm pressure threshold associated with the diaphragm 204. For example, a pressurized fluid, such as to pressurized fluid 170 of FIG. 1, may be flowed to the wellhead 160 at one or more pressures. As the pressure of the pressurized fluid 170 increases, the diaphragm 204 is deflected or transitioned to an energized position. As the diaphragm 204 transitions to the energized position, the diaphragm 204 contacts the pin 206. In one or more embodiments, the diaphragm 204 comprises a elastomer material.

A chamber 226 may comprise an adjusting nut 222, a compression assembly 208, a dart 210 and a pin 206. The pin 206 is disposed or positioned between the diaphragm 204 and the dart 210. In one or more embodiments, the dart 210 may be threaded in the pin 206 or otherwise coupled to the pin 206 such that the pin 206 and the dart 210 translationally move together within the chamber 226. As the diaphragm 204 applies a pressure on the pin 206 based on the pressurized fluid 170, a pressure is exerted against the dart 210 by the pin 206. In one or more embodiments, the dart 210 may be disposed at least partially within or coupled to a compression assembly 208, for example, a spring. An adjusting nut 222 is used to set a preloading force on the compression assembly 208. The pressure exerted against the dart 210 is compared to a compression threshold and based on this comparison the compression assembly 208 compresses allowing the dart 210 to translationally move towards the sensor 220. For example, when the pressure exerted against the dart 210 reaches or exceeds a compression threshold associated with the compression assembly 208, the dart 210 translationally moves towards the sensor 220. The sensor 220 detects or senses dart. For example, the sensor 220 detects the proximity, positioning, or location of the dart 210 to the sensor 220. The sensor 220 communicates or transmits one or more measurements or one or more signals to a controller, for example, controller 180 of FIG. 1. The one or more measurements or one or more signals may indicate that the proximity, location or distance of the dart 210 is at, about or within a reading range or location associated with the sensor 220. For example, the dart 210 is transitioned to a location that is sensed by the sensor 220. This reading range is based, at least in part, on a predetermined safe pressure for disengagement of the remote connector 120. Generally, the reading range is predetermined based on one or more factors related to safe pressures for disengagement of the remote connector 120 including but not limited to industry standards, customer requirements, specifications associated with the remote connector 120, any other standard, requirement or specification and any combination thereof. When the diaphragm 204 is deflected such that the dart 210 is at or about the predetermined reading range or location, the pressure switch assembly 150 is in the closed position.

In one or more embodiments, the sensor 220 may couple to a controller 180 of FIG. 1. The sensor 220 may communicate or transmit one or more measurements or signals to the controller 180. The one or more measurements or signals are indicative of an unsafe disengagement pressure such that the remote connector, for example, an EKQL, should be prevented from being disengaged from the wellhead. In one or more embodiments, the controller 180 may communicate or transmit a signal to the hydraulic system 102 that causes the hydraulic system 102 to bypass a hydraulic valve 104 that prevents the remote connector 120 from being disengaged from the wellhead 160. In one or more embodiments, any one or more of the hydraulics system 102, the hydraulic valve 104, and the actuator 106 may comprise a manual override. In one or more embodiments, sensor 220 may communicate or transmit one or more measurements or one or more signals to the controller 180 at one or more timed intervals, interrupts, semaphores or one or more other triggers, upon a detected pressure or location of the dart 210 (for example, when the proximity of the dart 210 to the sensor 220 is at or about the pressure threshold), upon a request from the controller 180, any other criteria, and any combination thereof.

In one or more embodiments, a pressure release 216 may comprise a cylindrical aperture that extends from a top of the pressure switch assembly 150 to the chamber 226. The pressure release 216 may provide a release for any trapped pressure in the chamber 226.

Figure 3:
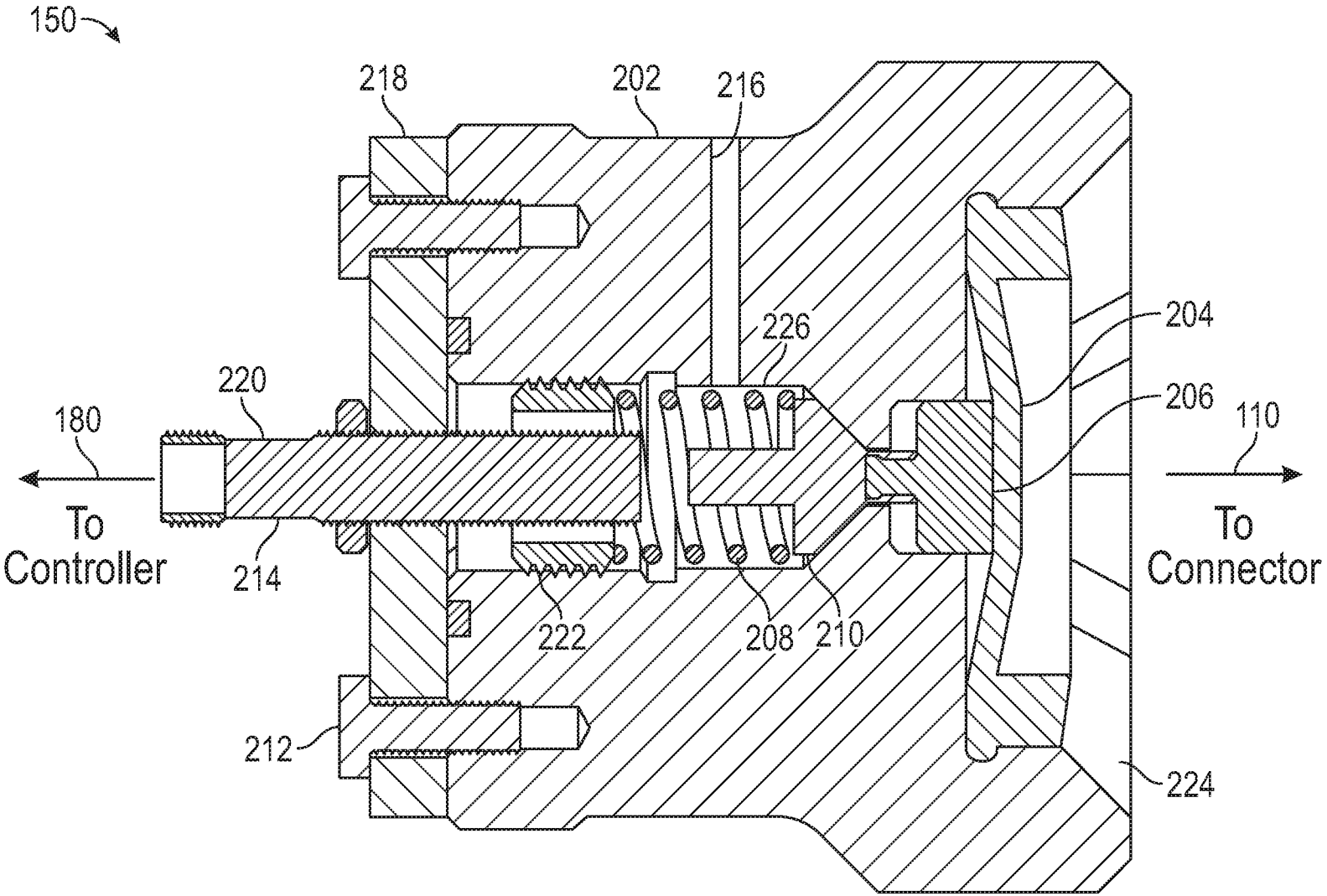
FIG. 3 is an illustrative pressure switch assembly in an open position, according to one or more aspects of the present disclosure.

FIG. 3 is an illustrative pressure switch assembly 150 in an open position, according to one or more aspects of the present disclosure. FIG. 3 illustrates the diaphragm 204 in an unenergized position such that the diaphragm 204 does not press, push or exert a force against the pin 206. For example, when pressure in the arm or line 140 is at a pressure that does cause the diaphragm 204 to deflect as discussed above with respect to FIG. 2, the pressure switch assembly 150 is in an open position and the remote connector is disengageable from the wellhead. For example, to the controller 180 may receive one or more measurements from the sensor 220 and communicate or transmit a signal to a hydraulics system 102 based on the one or more measurements that allows or permits a hydraulic valve 104 to be released and the remote connector 120 to be disengaged from the wellhead 160.

If the pressure switch assembly 150 is in a closed position, as discussed above with respect to FIG. 2, once the pressure of the pressurized fluid 170 falls below a pressure level that causes deflection of the diaphragm 204, the pressure switch assembly 150 transitions to an open position as illustrated in FIG. 3.

Figure 4:
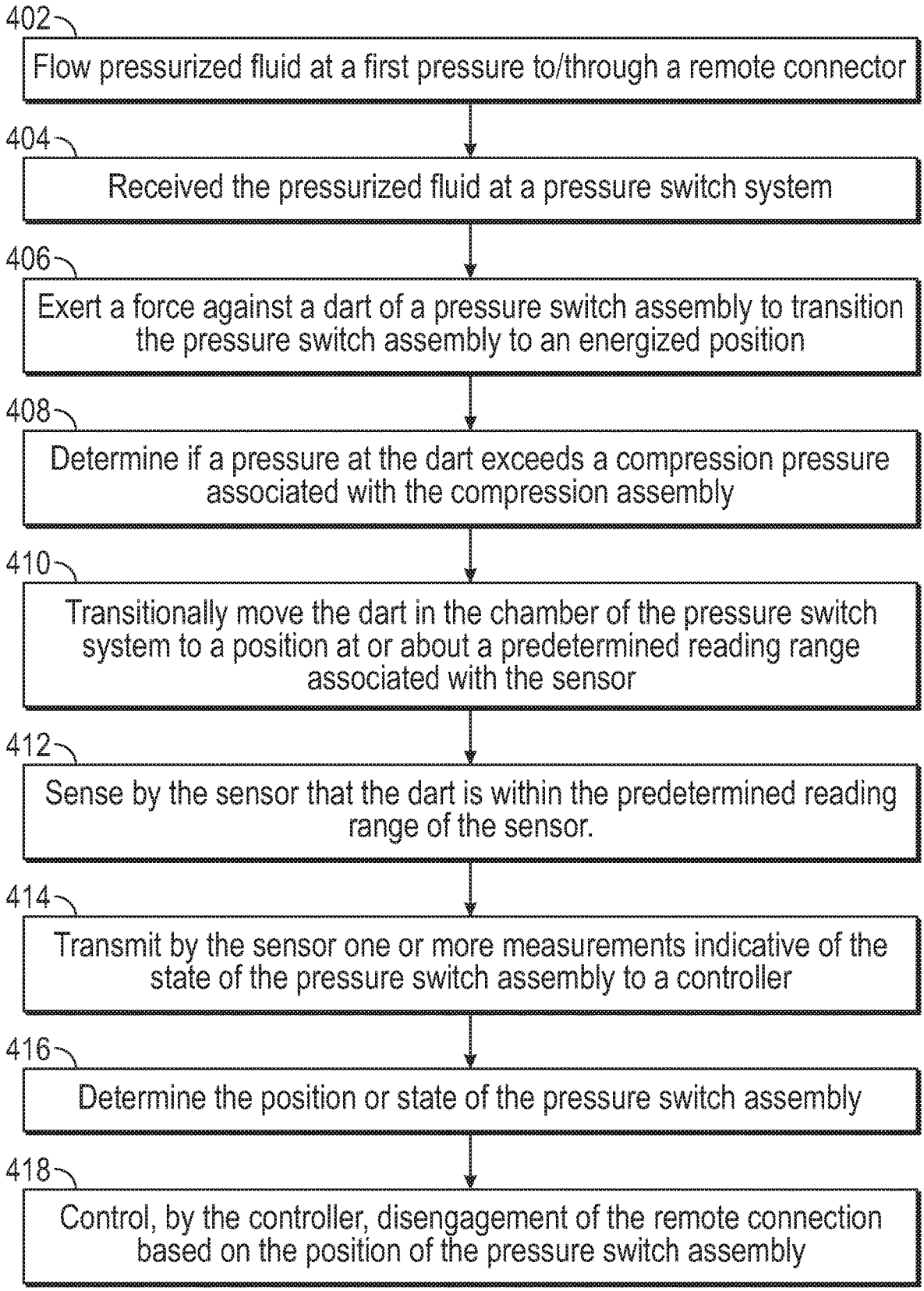
FIG. 4 is a flowchart for a method of controlling disengagement of a remote controller using a pressure switch system, according to one or more aspects of the present disclosure.

FIG. 4 is a flowchart for controlling disengagement of a remote connector using a pressure switch system 190, according to one or more aspects of the present disclosure. At step 402, a pressurized fluid 170 is flowed at a first pressure to or through a remote connector 120 coupled to an arm 140 of a WCU 105 to a wellhead 160. At step 404, the pressure switch assembly 150 of a pressure switch system 190 receives the pressurized fluid 170. Based on the first pressure, the diaphragm 204 of the pressure switch assembly 150 transitions to an energized position. At step 406, the deflection or transition of the diaphragm 204 causes a pin 206 disposed or positioned between the diaphragm 204 and a dart 210 to press, push, contact or otherwise exert a force against the dart 210. At step 408, it is determined if a pressure at the dart 210 exceeds a compression pressure associated with the compression assembly 208 based, at least in part, on any one or more of the first pressure, the diaphragm 204 and the pin 206. For example, when the first pressure is at or exceeds the diaphragm pressure threshold, the diaphragm 204 transitions to the energized position which causes lathe diaphragm 204 to press against the pin 206. When the diaphragm 204 presses against the pin 206, the pin 206 to apply a pressure or force against the dart 210 that exceeds a compression pressure associated with the compression assembly 208. At step 410, the dart 210 based, at least in part, on the first pressure and contact with the pin 206 moves transitionally or translationally in a chamber 226 such that the dart 210 is positioned or located at or about a predetermined reading range associated with the sensor 220. For example, the predetermined reading range or location may be set to indicate that a pressure threshold has been reached or exceeded such that disengagement of the remote connector 120 would cause harm to personnel, the surrounding environment or both.

At step 412, the sensor 220 senses the dart 210 as the dart 210 has translationally moved within the predetermined reading range associated or location with the sensor 220. At step 414, the sensor 220 transmits or communicates one or more measurements or one or more signals to a controller 180 of the pressure switching system indicative of the state of the pressure switch assembly 150. For example, the pressure switch assembly 150 is in a closed position when the dart 210 is within the predetermined reading range or location. In one or more embodiments, the one or more measurements or one or more signals are indicative of the positioning or location of the dart 210. At step 416, the controller 180, after receiving the one or more measurements or one or more signals, determines the state or positions of the pressure switch assembly 150. For example, the controller 180 determines if the pressure switch assembly 150 is in a closed position based on the one or more measurements or the one or more signals from the sensor 220.

At step 418, the controller 180 controls disengagement of the remote connector 120 using the pressure switch system 190 based, at least in part, on the determination from step 416. In one or more embodiments, the controller 180 coupled to the pressure switch assembly 150 communicates or transmits one or more signals to a hydraulics system 102 based on the one or more measurements or the state of the pressure switch assembly 150. For example, the controller 180 communicates or transmits one or more signals to the hydraulics system 102 that causes the hydraulics line 108 to bypass a hydraulic valve 104 when the pressure switch assembly 150 is in a closed position. Bypass of the hydraulic valve 104 prevents disengagement of the remote connector 120 from the wellhead 160. For example, the pressure switch assembly 150 transitions between an open position and a closed position based on a pressure and this transition between positions controls the disengagement of the remote connector 120.

Figure 5:
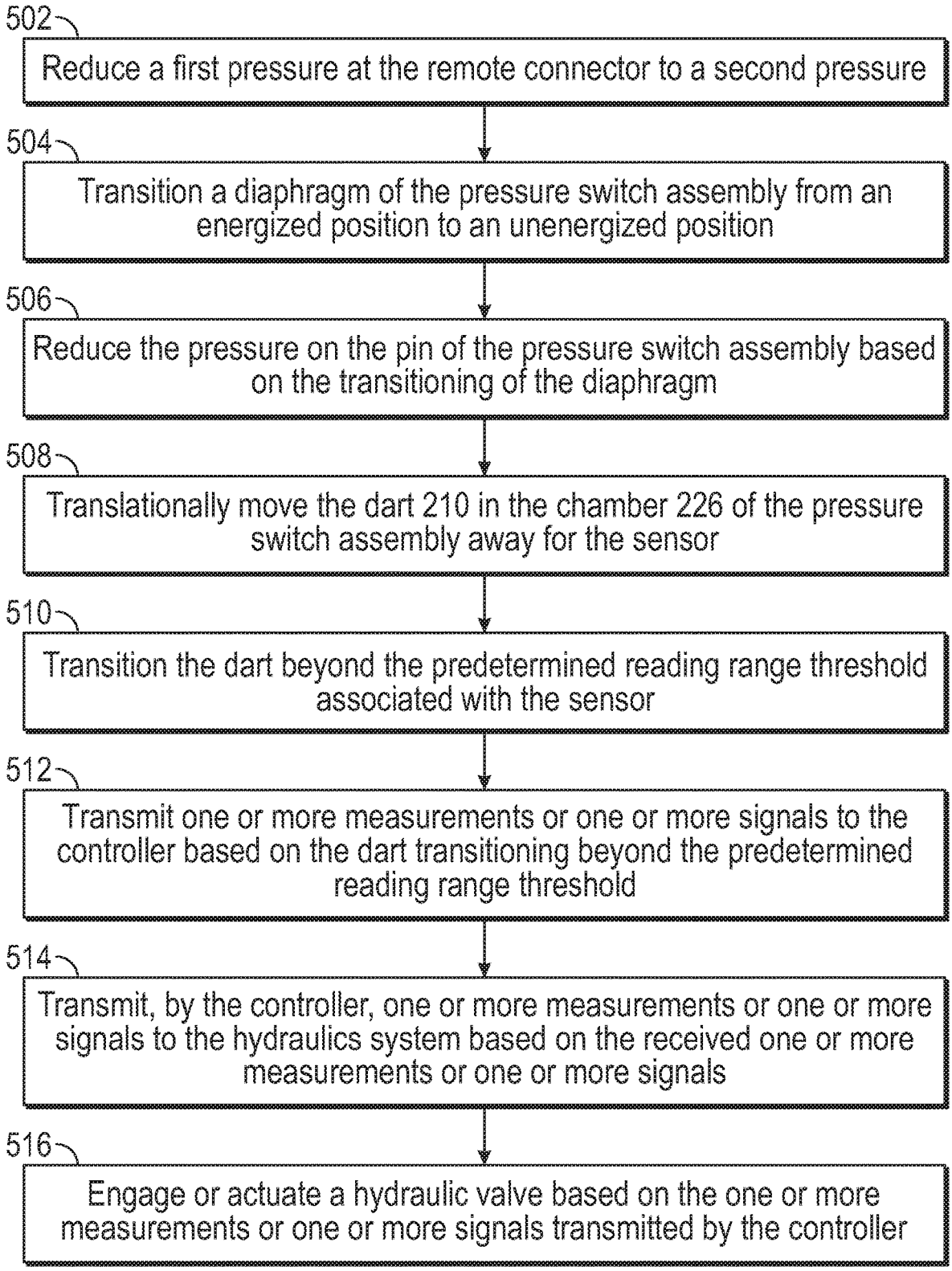
FIG. 5 is a flowchart for a method of controlling disengagement of a remote connector using a pressure switch system, according to one or more aspects of the present disclosure.

FIG. 5 is a flowchart for a method of controlling disengagement of a remote connector 120 using a pressure switching system 190, according to one or more aspects of the present disclosure. At step 502, the first pressure at the remote connector 120 is reduced to a second pressure. For example, the pressure of the pressurized fluid 170 flowed through a remote connector 120 coupled to an arm 140 of a WCU 105 is reduced or flow of the pressurized fluid 170 is discontinued or reduced to a second pressure. At step 504, as pressure of the pressurized fluid 170 reaches or falls below the second pressure, the diaphragm 204 transitions from the energized position as discussed above with respect to FIG. 4 to an unenergized position. At step 506, as the diaphragm 204 retracts or transitions to the unenergized position, the force or pressure on the pin 206 is reduced based on the transitioning of the diaphragm 204. At step 508, as the pressure on the pin 206 is reduced the dart 210 transitions away or the dart 210 translationally moves in the chamber 226 away from the sensor 220 or outside the predetermined reading range, for example, a predetermined reading threshold or location. For example, the pressure from the pin 206 exerted or applied on the dart 210 is compared to the compression threshold of the compression assembly 208. Based on this comparison, the compression assembly 208 expands or uncompresses causing the dart to transition away from the sensor 220 toward the diaphragm 204.

At step 510, the dart 210 is transitioned beyond the predetermined reading threshold or location associated with the sensor 220. At step 512, the sensor 220 communicates or transmits one or more measurements or one or more signals to the controller 180. At step 514, after the controller 180 receives the one or more measurements, the controller 180 communicates or transmits one or more signals to the hydraulics system 102 based on the received one or more measurements or one or more signals. At step 516, the hydraulics system 102 engages or actuates a hydraulic valve 104 such that the remote connector 120 is disengageable from the wellhead 160 based on the one or more measurements or one or more signals transmitted by the controller 180.

Figure 6:
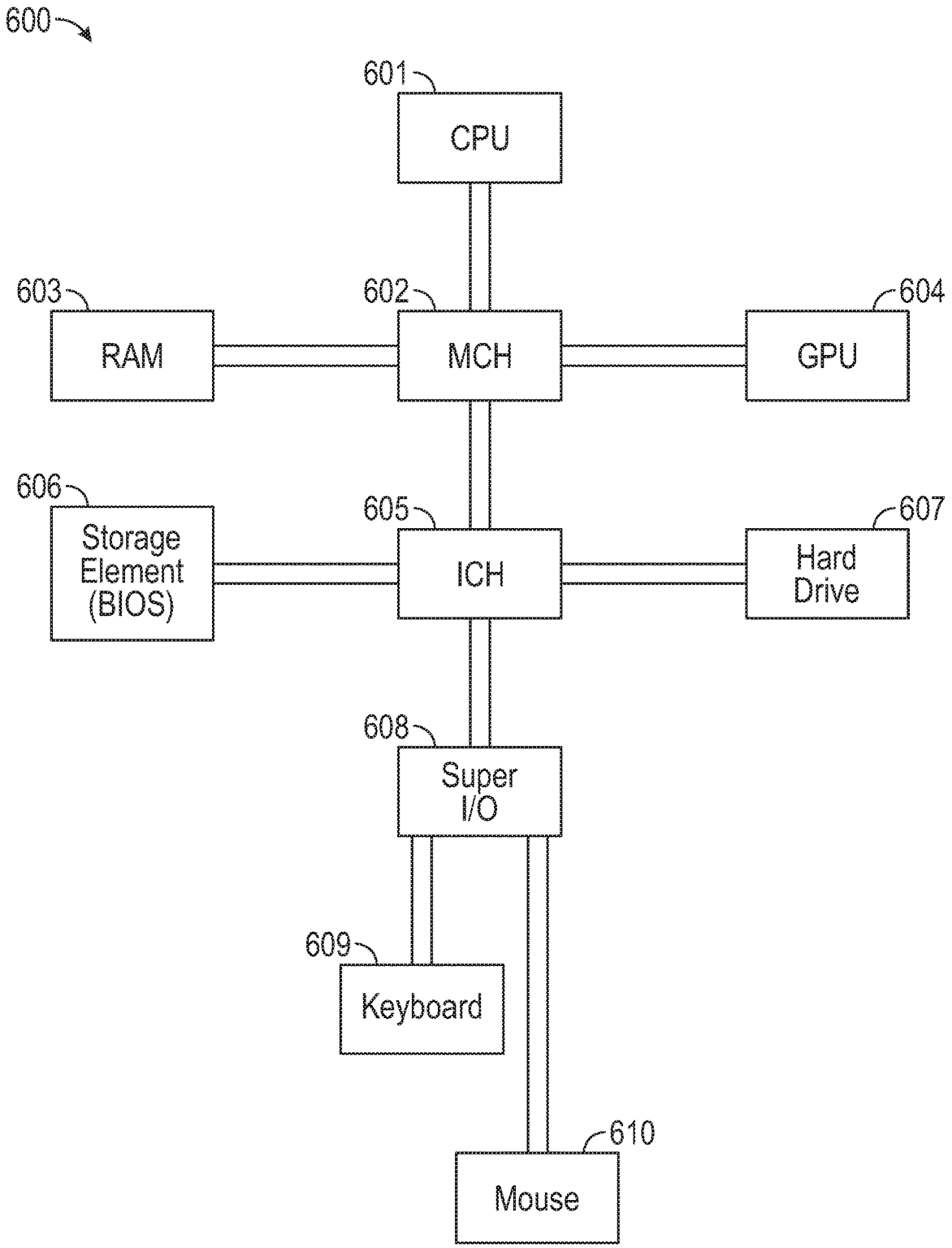
FIG. 6 is a diagram illustrating an information handling system, according to one or more aspects of the present disclosure.

FIG. 6 is a diagram illustrating an example information handling system 600, according to one or more aspects of the present disclosure. The controller 180 may take a form similar to the information handling system 600. A processor or central processing unit (CPU) 601 of the information handling system 600 is communicatively coupled to a memory controller hub (MCH) or north bridge 602. The processor 601 may include, for example a microprocessor, microcontroller, digital signal processor (DSP), application specific integrated circuit (ASIC), or any other digital or analog circuitry configured to interpret and/or execute program instructions and/or process data. Processor 601 may be configured to interpret and/or execute program instructions or other data retrieved and stored in any memory such as memory 603 or hard drive 607. Program instructions or other data may constitute portions of a software or application for carrying out one or more methods described herein. Memory 603 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software or application may be retrieved and stored in memory 603 for execution by processor 601.

Modifications, additions, or omissions may be made to FIG. 6 without departing from the scope of the present disclosure. For example, FIG. 6 shows a particular configuration of components of information handling system 600. However, any suitable configurations of components may be used. For example, components of information handling system 600 may be implemented either as physical or logical components. Furthermore, in some embodiments, functionality associated with components of information handling system 600 may be implemented in special purpose circuits or components. In other embodiments, functionality associated with components of information handling system 600 may be implemented in configurable general purpose circuit or components. For example, components of information handling system 600 may be implemented by configured computer program instructions.

Memory controller hub 602 may include a memory controller for directing information to or from various system memory components within the information handling system 600, such as memory 603, storage element 606, and hard drive 607. The memory controller hub 602 may be coupled to memory 603 and a graphics processing unit (GPU) 604. Memory controller hub 602 may also be coupled to an I/O controller hub (ICH) or south bridge 605. I/O controller hub 605 is coupled to storage elements of the information handling system 600, including a storage element 606, which may comprise a flash ROM that includes a basic input/output system (BIOS) of the computer system. I/O controller hub 605 is also coupled to the hard drive 607 of the information handling system 600. I/O controller hub 605 may also be coupled to an I/O chip or interface, for example, a Super I/O chip 608, which is itself coupled to several of the I/O ports of the computer system, including keyboard 609 and mouse 610.

In one or more embodiments, a pressure switch system comprises a pressure switch assembly fluidly coupled to a wellhead, wherein the pressure switch assembly comprises a diaphragm, a pin coupled to the diaphragm, a dart coupled to the pin and a sensor proximal to the dart, a remote connector coupled to the wellhead and a controller coupled to the pressure switch assembly, wherein the sensor transmits one or more measurements to the controller when the dart is within a reading range associated with the sensor, and wherein the controller controls disengagement of the remote connector based on the one or more measurements. In one or more embodiments, the pressure switch assembly further comprises a compression assembly, wherein the dart is at least one of disposed within or coupled to the compression assembly. In one or more embodiments, wherein the compression assembly comprises a spring. In one or more embodiments, the pressure switch assembly further comprises an adjusting nut that sets a preloading force on the compression assembly. In one or more embodiments, the system further comprises a first arm coupled to the pressure switch assembly and a manifold and a second arm coupled to the pressure switch assembly and the remote connector; where fluid flows from the manifold to the wellhead. In one or more embodiments, the system further comprises a hydraulics unit, wherein the hydraulics unit comprises an actuator communicatively coupled to the controller, a hydraulic valve coupled to the remote connector and a hydraulic line coupled to the hydraulic valve and the actuator, wherein actuation of the hydraulic valve by the actuator allows the remote connector to be disengaged from the wellhead. In one or more embodiments, the controller controls actuation of the actuator based on the one or more measurements.

In one or more embodiments, a method for controlling disengagement of a remote connector comprises flowing a fluid at a first pressure through a remote connector to a wellhead, wherein a pressure switch assembly is coupled to the remote connector, and wherein the pressure switch assembly comprises a diaphragm, a pin coupled to the diaphragm, a dart coupled to the pin and a sensor proximal to the dart, transitioning the diaphragm to an energized position based on the first pressure to exert a force against the pin, pressing the pin against the dart based on the force, transitioning the dart to a location within a reading range associated with the sensor, detecting by the sensor the dart and controlling disengagement of the remote connector based on one or more measurements from the sensor. In one or more embodiments, transitioning the dart to the location within the reading range comprises compressing a compression assembly, wherein the draft is at least one of disposed within or coupled to the compression assembly. In one or more embodiments, the compression assembly comprises a spring. In one or more embodiments, the pressure switch assembly further comprises an adjusting nut that sets a preloading force on the compression assembly. In one or more embodiments, controlling disengagement of the remote connector comprises actuating a hydraulic valve, wherein the hydraulic valve is coupled to the remote connector. In one or more embodiments, the controller controls actuation of the hydraulic valve based on the one or more measurements.

In one or more embodiments, a pressure switch assembly fluidly coupled to a wellhead comprises a diaphragm, a pin coupled to the diaphragm, a dart coupled to the pin and a sensor proximal to the dart, a remote connector coupled to the wellhead, at least one processor and a memory including non-transitory executable instructions that, when executed, cause the at least one processor to receive one or more measurements from the sensor when the dart is within a reading range associated with the sensor and control disengagement of the remote connector based on the one or more measurements. In one or more embodiments the pressure switch assembly further comprises a compression assembly, wherein the dart is at least one of disposed within or coupled to the compression assembly. In one or more embodiments, the compression assembly comprises a spring. In one or more embodiments, the one or more measurements are indicative of an unsafe disengagement pressure. In one or more embodiments, the non-transitory executable instructions that, when executed, further cause the at least one processor to transmit a signal to a hydraulic system, wherein the signal causes the hydraulic system to bypass a hydraulic valve that prevents the remote connector from being disengaged from the wellhead. In one or more embodiments, the non-transitory executable instructions that, when executed, further cause the at least one processor to receive from the sensor one or more measurements indicative of a state of the pressure switch assembly. In one or more embodiments, controlling disengagement of the remote connector is based on the state of the pressure switch assembly.

As would be appreciated by those of ordinary skill in the art, with the benefit of this disclosure, the methods of the present disclosure may be implemented on virtually any type of information handling system regardless of the platform being used. Moreover, one or more elements of the information handling system may be located at a remote location and connected to the other elements over a network. In a further embodiment, the information handling system may be implemented on a distributed system having a plurality of nodes. Such distributed computing systems are well known to those of ordinary skill in the art and will therefore not be discussed in detail herein.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are each defined herein to mean one or more than one of the element that it introduces.

A number of examples have been described. Nevertheless, it will be understood that various modifications can be made. Accordingly, other implementations are within the scope of the following claims.

What is claimed is:

1. A pressure switch system, comprising:

a pressure switch assembly fluidly coupled to a wellhead, wherein the pressure switch assembly comprises:

a diaphragm disposed at a first end of the pressure switch assembly, wherein the diaphragm is deflectable to an energized position based on a pressurized fluid;

a pin coupled to the diaphragm;

a dart coupled to the pin, wherein the pin is disposed between the dart and the diaphragm, and wherein the diaphragm exerts a force on the pin as the diaphragm transitions to the energized position such that the force on the pin exerts a pressure on the dart; and a sensor at a second end of the pressure switch assembly and proximal to the dart, wherein the dart translationally moves towards the sensor based on the pressure on the dart exerted by the pin;

a remote connector coupled to the wellhead; and a controller coupled to the pressure switch assembly, wherein the sensor transmits one or more measurements to the controller as the dart translationally moves towards the sensor to within a reading range associated with the sensor, and wherein the controller controls disengagement of the remote connector based on the one or more measurements.

2. The system of claim 1, wherein the pressure switch assembly further comprises a compression assembly, wherein the dart is at least one of disposed within or coupled to the compression assembly.

3. The system of claim 2, wherein the compression assembly comprises a spring.

4. The system of claim 2, wherein the pressure switch assembly further comprises an adjusting nut that sets a preloading force on the compression assembly.

5. The system of claim 1, further comprising:

a first arm coupled to the pressure switch assembly and a manifold; and a second arm coupled to the pressure switch assembly and the remote connector;

where fluid flows from the manifold to the wellhead.

6. The system of claim 1, further comprising:

a hydraulics unit, wherein the hydraulics unit comprises:

an actuator communicatively coupled to the controller;

a hydraulic valve coupled to the remote connector; and a hydraulic line coupled to the hydraulic valve and the actuator, wherein actuation of the hydraulic valve by the actuator allows the remote connector to be disengaged from the wellhead.

7. The system of claim 6, wherein the controller controls actuation of the actuator based on the one or more measurements.

8. A method for controlling disengagement of a remote connector, comprising:

flowing a fluid at a first pressure through a remote connector to a wellhead, wherein a pressure switch assembly is coupled to the remote connector, and wherein the pressure switch assembly comprises:

a diaphragm disposed at a first end of the pressure switch assembly, wherein the diaphragm is deflectable to an energized position based on the fluid;

a pin coupled to the diaphragm;

a dart coupled to the pin, wherein the pin is disposed between the dart and the diaphragm, and wherein the diaphragm exerts a force on the pin as the diaphragm transitions to the energized position such that the force on the pin exerts a pressure on the dart; and a sensor at a second end of the pressure switch assembly and proximal to the dart;

transitioning the diaphragm to an energized position based on the first pressure to exert the force against the pin;

exerting the pressure by the pin against the dart based on the force;

transitioning the dart to a location within a reading range associated with the sensor based on the pressure on the dart exerted by the pin;

detecting by the sensor the dart when the dart is within the reading range associated with the sensor; and controlling disengagement of the remote connector from the wellhead based on one or more measurements from the sensor.

9. The method of claim 8, wherein transitioning the dart to the location within the reading range comprises compressing a compression assembly, wherein the dart is at least one of disposed within or coupled to the compression assembly.

10. The method of claim 9, wherein the compression assembly comprises a spring.

11. The method of claim 9, wherein the pressure switch assembly further comprises an adjusting nut that sets a preloading force on the compression assembly.

12. The method of claim 8, wherein controlling disengagement of the remote connector comprises actuating a hydraulic valve, wherein the hydraulic valve is coupled to the remote connector.

13. The method of claim 12, wherein the controller controls actuation of the hydraulic valve based on the one or more measurements.

14. A pressure switch assembly fluidly coupled to a wellhead, comprising:

a diaphragm disposed at a first end of the pressure switch assembly, wherein the diaphragm is deflectable to an energized position based on a pressurized fluid;

a pin coupled to the diaphragm;

a dart coupled to the pin, wherein the pin is disposed between the dart and the diaphragm, and wherein the diaphragm exerts a force on the pin as the diaphragm transitions to the energized position such that the force on the pin exerts a pressure on the dart; and a sensor at a second end of the pressure switch assembly and proximal to the dart, wherein the dart translationally moves towards the sensor based on the pressure on the dart exerted by the pin;

a remote connector coupled to the wellhead;

at least one processor; and a memory including non-transitory executable instructions that, when executed, cause the at least one processor to:

receive one or more measurements from the sensor as the dart translationally moves towards the sensor to within a reading range associated with the sensor; and control disengagement of the remote connector based on the one or more measurements.

15. The pressure switch assembly of claim 14, further comprising:

a compression assembly, wherein the dart is at least one of disposed within or coupled to the compression assembly.

16. The pressure switch assembly of claim 14, wherein the compression assembly comprises a spring.

17. The pressure switch assembly of claim 14, wherein the one or more measurements are indicative of an unsafe disengagement pressure.

18. The pressure switch assembly of claim 14, wherein the non-transitory executable instructions that, when executed, further cause the at least one processor to transmit a signal to a hydraulic system, wherein the signal causes the hydraulic system to bypass a hydraulic valve that prevents the remote connector from being disengaged from the wellhead.

19. The pressure switch assembly of claim 14, wherein the non-transitory executable instructions that, when executed, further cause the at least one processor to receive from the sensor one or more measurements indicative of a state of the pressure switch assembly.

20. The pressure switch assembly of claim 19, wherein controlling disengagement of the remote connector is based on the state of the pressure switch assembly.

* * * * *